United States Patent [19]

Vargas

[11] Patent Number: 4,934,558

[45] Date of Patent: Jun. 19, 1990

[54] MULTIPLE SIZE DISPOSABLE PLASTIC CUP LID

[76] Inventor: Ky Vargas, 2648 W. El Paso St., Broken Arrow, Okla. 74012

[21] Appl. No.: 402,630

[22] Filed: Sep. 5, 1989

[51] Int. Cl.[5] ..... B65D 51/00

[52] U.S. Cl. ..... 220/287

[58] Field of Search ..... 220/287

[56] References Cited

U.S. PATENT DOCUMENTS

| | | | |
|---|---|---|---|
| 342,379 | 5/1986 | Nye | 220/287 |
| 392,762 | 11/1888 | Stilson | 220/287 |
| 947,098 | 1/1910 | Ellis | 220/287 |
| 1,025,090 | 4/1912 | Holmes | 220/287 |
| 1,322,863 | 11/1919 | Roeger et al. | 220/287 |
| 1,524,185 | 1/1925 | Lockwood | 220/4 R |
| 2,456,912 | 12/1948 | Burrows | 210/495 |
| 3,557,995 | 1/1971 | Mirasol, Jr. et al. | 220/287 |
| 3,655,089 | 4/1972 | Tower | 220/287 |
| 4,198,040 | 4/1980 | Colasent | 220/254 |
| 4,359,076 | 11/1982 | Kyte | 141/391 |

*Primary Examiner*—Stephen Marcus
*Assistant Examiner*—Nova Stucker

[57] ABSTRACT

A multiple size disposable plastic cup lid comprising a flat circular disk of plastic with a premolded lip on the outer circumference that engages to the top edge of a drinking cup during use and wherein a plurality of radial creases or hinges from the center of the circular disk to the outer circumference allows the lid to be folded about various pairs of creases thus forming various cone shaped configurations that fit a series of smaller discrete container sizes. The multiple size cup lid can be further provided with a series of premolded indentations that tend to hold the lid in a folded cone shaped configuration.

6 Claims, 3 Drawing Sheets

MULTIPLE SIZE DISPOSABLE PLASTIC CUP LID

BACKGROUND OF THE INVENTION

1. Field of the Invention:

This invention relates to an improved disposable plastic lid for use with drinking cups or containers. More specifically, the invention relates to a multiple size plastic lid that will fit a series of specific discrete container sizes.

2. Description of the Prior Art:

It is generally known and a common commercial practice to provide a disposable container such as beverage cups or the like with a plastic lid or closure. For example, the contemporary convenience store will now provide self-service drink dispensing equipment wherein the customer selects a disposable container according to the size and type of drink to be purchased. Along with the various sizes and type of disposable container, there will be an array of various size plastic lids to be used on various size beverage containers. In addition to the obvious disadvantages associated with displaying and dispensing a large inventory of sizes, the present system also creates problems associated with the inconvenience to the customer of selecting matching the right size of lid with the selected container size. All of which could be, at least in principle, either alleviated or eliminated by providing a single lid that fits multiple container sizes.

SUMMARY OF THE INVENTION

In view of the pragmatic problems associated with the contemporary self-service soft drink dispensing business, the present invention provides a multiple size disposable plastic cup lid that can be manufactured inexpensively and easily used by virtually anyone. According to the present invention, a plastic cup lid is provided such as to fit a relatively large size drink container in a manner essentially analogous to conventional large size lids. However, the disposable lid according to the present invention further provides for at least one fan shaped segment in the otherwise circular shaped lid which when folded back on itself forms a cone shaped surface with smaller circular opening that then fits on a smaller drinking cup, thus serving as a multiple size lid. By providing a plurality of hinged creases in overlapping or segmented fan shaped regions of the circular lid, up to four discrete cup sizes can be readily accommodated by a single lid.

Thus, the present invention provides a multiple size lid comprising a circular disk of plastic having a plurality of hinge forming means positioned radially from the center of the circular disk to the outer circumference for allowing the disk to be folded about a pair of hinge forming means, thus forming a conical shaped surface, and wherein the circular disk of plastic has a lip engaging means integrally formed on the outer circumference for engaging to the lip of a relatively large size container when used as a flat lid and for engaging to itself as well as the lip of a relatively smaller size container when used as a folded conical shaped lid.

In one particular advantageous embodiment of the present invention, the folded circular disk is held in the conical configuration or shape during use on relatively smaller size cups by virtue of the presence of an interlocking means molded into the circular disk. Typically, the presence of three precreased hinge forming means in a single circular disk lid will be sufficient to accommodate up to four sizes of drinking cups.

It is an object of the present invention to provide an inexpensive disposable drinking cup lid that is easily used in a manner analogous to the conventional disposable drinking cup lid, but is also adjustable such as to fit a series of discrete cup sizes. It is a further object of the present invention to provide a multiple size plastic lid that can be easily folded such as to fit various standard size cups, yet will remain essentially sealed when in use. Fulfillment of these objects and the presence and fulfillment of other objects will be apparent upon reading the complete specification and claims taken in conjunction with the attached drawings.

DESCRIPTION OF THE PREFERRED EMBODIMENTS

Figure 1:
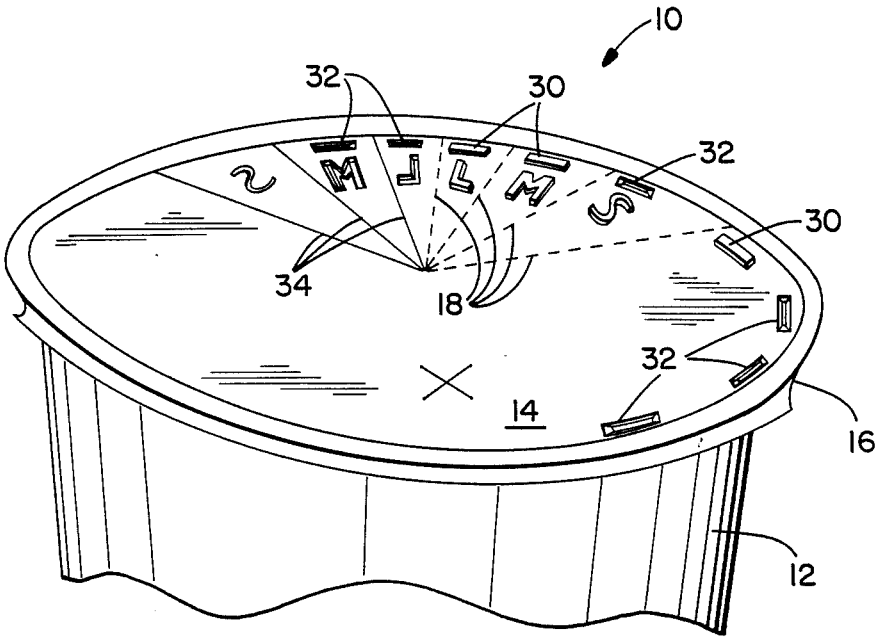
FIG. 1 is a perspective view of the multiple size disposable plastic cup lid according to the present invention in an unfolded configuration covering a relatively large size drinking container.
Figure 2:
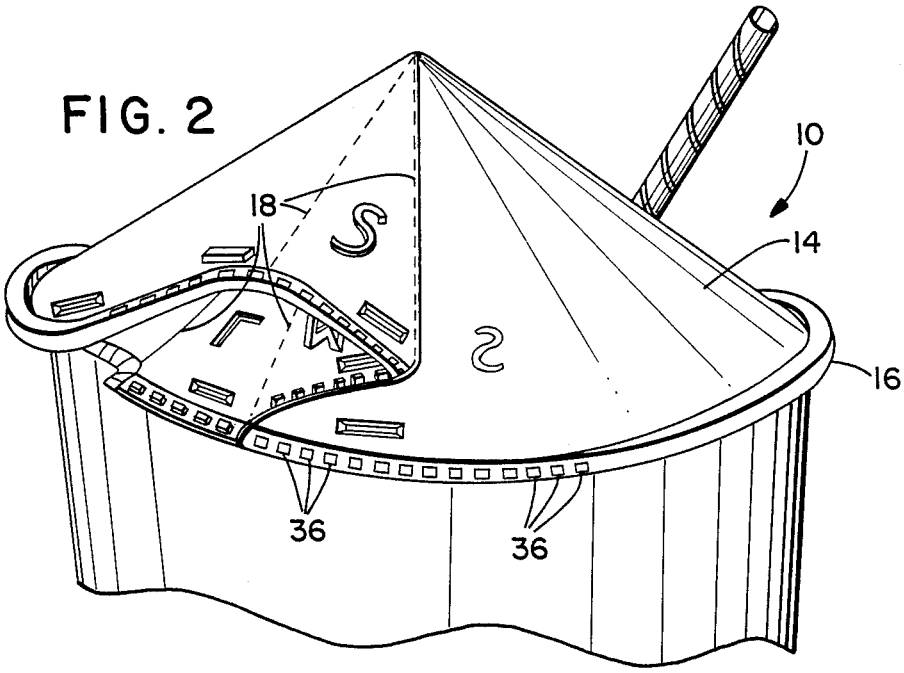
FIG. 2 is a perspective view of the multiple size disposable plastic cup lid of FIG. 1 being folded into a conical configuration such as to cover a relatively smaller size drinking container.

The multiple size disposable plastic cup lid according to the present invention, how it is manufactured and how it functions, as well as how it differs from prior art lids and the advantages over what has previously been used can perhaps be best explained and understood by reference to the drawings. FIG. 1 illustrates one particular embodiment of a multiple size lid according to the present invention, generally designated by the numeral 10. As shown in this drawing, the lid 10 when employed in the unfolded flat configuration attaches to the upper lip of a conventional drink container 12, partially illustrated in the drawing. The lid 10 is molded or fabricated in the form of a flat plastic circular disk 14 with the outer circumference of the disk possessing a mold lip engaging means 16, much like a conventional disposable lid. Structurally, the lid 10 according to the present invention differs from the conventional disposable lid in that the flat plastic circular disk 14 is provided with a plurality of (at least two) radially positioned hinge means 18 that extend from substantially the center of the circular disk 10 radially outward to the circumference or circular lip of the overall lid 10. In this specific embodiment a set of four hinge means 18 sequentially positioned adjacent to each other are provided such as to allow for the formation of three different relatively smaller size conical configurations. Each pair of radial hinge means 18 define a fan shape segment of the flat disk 14 which can be folded back on the rest of the circular disk 14 forcing the lid 10 into a conical configuration (see FIG. 2). In this cone shaped configuration, the circumference of the lip engaging structure 16 is reduced by the length of the arc between the pair of hinge means 18 and thus the lid is compatible with covering the top of a smaller size drinking cup (again, see FIG. 2).

Figure 3:
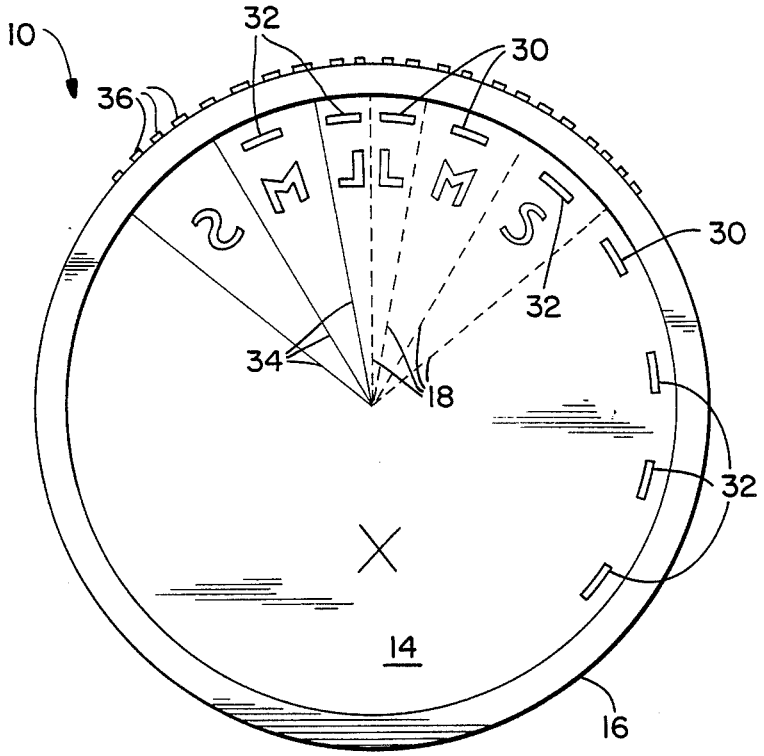
FIG. 3 is a top plan view of the multiple size lid of FIGS. 1 and 2.
Figure 4:
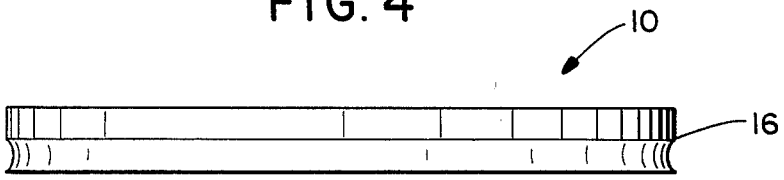
FIG. 4 is a side view of the multiple size lid of FIG. 3.

As further suggested in FIGS. 3 and 4, the plurality of hinge means 18 of lid 10 are preferably either molded grooves, cuts, scoring or indentations in the plastic disk 14 that represent relatively thin regions in the polymeric film or sheet used to make the overall lid. Because of the reduced dimension at these radial lines 18, the fan shaped region between respective pairs of hinges will readily fold back on the rest of the circular disk 14. Optionally, to assist in this folding action the outer perimeter of the lip engaging means 16 is slightly scored, notched or slit at the intersection of the lip engaging means 16 (not shown). This allows the portion of the lip engaging means 16 that is located between these notches to distort and actually interlock with the folded portion of the engaging means 16 such as to hold and retain the overall lid in a cone shaped configuration.

To further assist in retaining the folded lid of the present invention in a conical configuration for use on smaller size drinking cups, the circular disk can be further provided with a series of protrusions/indentations positioned along an arc relative to the center of the circle and displaced symmetrical about the radial hinge lines 28. These protrusions/indentations preferably snap together when the lid is folded about hinge lines 28.

As further illustrated in the drawings, these protrusions/indentions can be positioned at various locations and can be present in various forms. For example, the embodiment of FIGS. 1 through 4 contains three separate types of interlocking means. Along the outer perimeter of the flat surface 14 are a series of rectangular arcs 30 and 32 symmetrically positioned about respective hinge means 28. These arcs 30 and 32 are generally of a frusto-triangular cross-section such that when the outward protruding arcs 30 are folded about the hinge means 28 they wedge into the inwardly protruding arc 32 creating a compressive fit. Similarly, the respective fan shaped regions between the hinge means 28 have either raised of indented letters of wedge producing cross-section that interlock with indented of raised mirror images of these letters symmetrically positioned in the other side of the right most (vertical dashed line in FIGS. 1 and 3) hinge means. These mirror images of the letter are further highlighted or marked with phantom radial lines 34 to visually assist the user in selecting where to fold the lid to fit the respective container size selected to be covered. The use of the letters "S", "M" and "L" are convenient in that the user can select the hinge means associated with the respective letter according to where a small, medium or large size cup is to be covered. Of course, no folding of the disc corresponds to the x-large size. As further illustrated in FIG. 2, the protrusions/indentions making up the interlocking means can actually be a series of evenly spaced frusto-pyramidal protrusions 36 molded into the lip of the lid (see FIG. 2).

Figure 5:
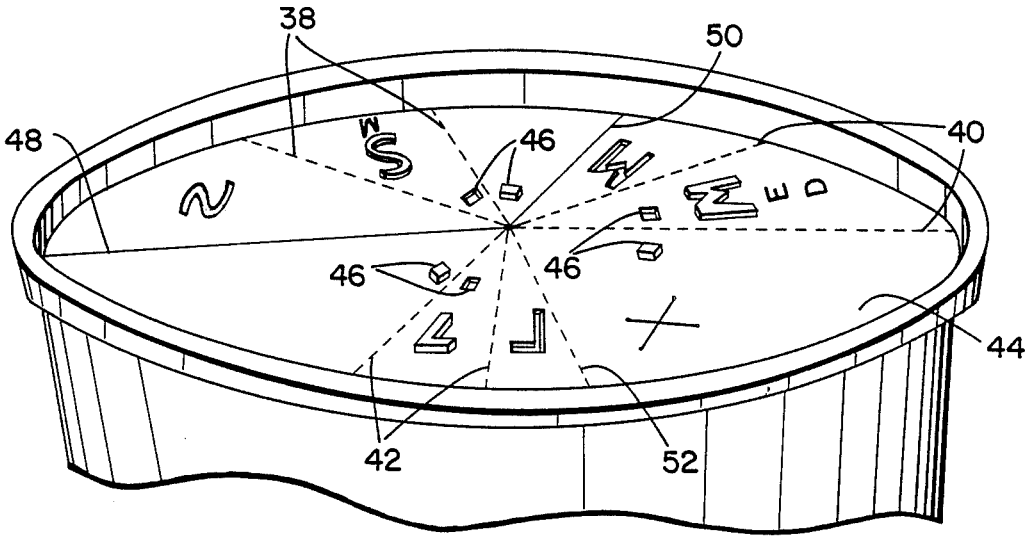
FIG. 5 illustrates an alternate embodiment of a multiple size lid according to the present invention.
Figure 6:
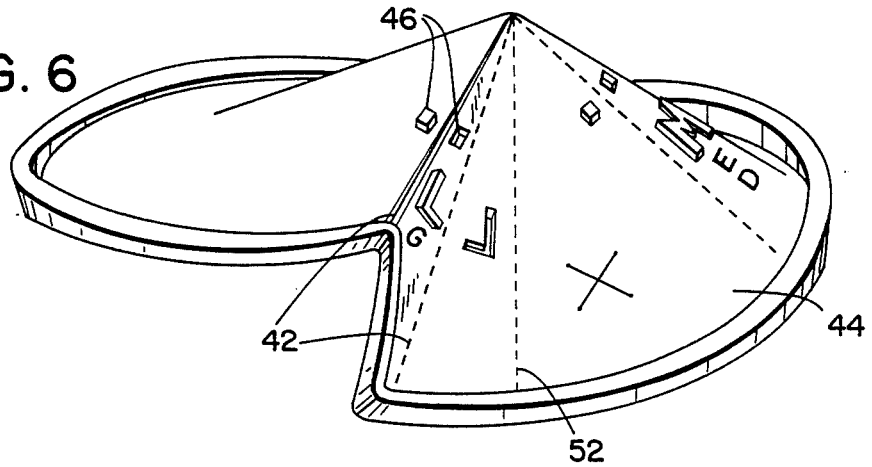
FIG. 6 illustrates the multiple size lid of FIG. 5 being folded to fit the next size smaller drinking cup.
Figure 7:
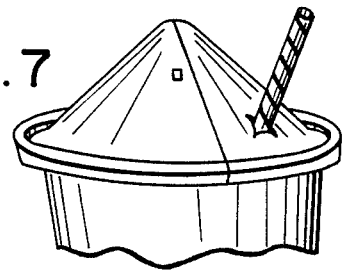
FIG. 7 illustrates the folded multiple size lid of FIG. 5 during use covering a relatively smaller size drinking cup.

FIGS. 5, 6 and 7 illustrate an alternate embodiment of the present invention wherein a multi size lid fitting four sizes of containers is achieved by the use of three separate pairs of hinge means 38, 40 and 42 distributed about the circular plastic dish 44 at different regions. Again the respective regions or pie shape segments to be superimposed and interlocked to achieve a conical configuration that fits relatively smaller sizes utilizes a letter-/inverted letter locking means "S", "M" or "L" as well as a pair of interlocking frusto-pyramidal protrusions 46 to assist in retaining the conical configuration during use. Also, a phantom radial line 48, 50 and 52 is used with each pair of hinge means to assist the user in determining where to fold and superimpose fan segments to achieve the conical configuration. Optionally, the lid can be cut to accommodate a straw as conventionally known in the art (see FIGS. 2 and 7).

The actual manufacturing of the disposable multiple size lid according to the present invention can be by any of the conventional methods as generally known in the art, including by way of example, but not limited thereto, injection molding or vacuum forming. The selection of material employed in fabricating the lid can be from any of the well known plastic generally used to make disposable lids, including by way of example, but not limited thereto, polystyrene, various impact grades of polystyrene and/or copolymers of styrene, various polyolefins such as polyethylene, polypropylene or the like, various polyacrylates or vinyl polymers and vinyl copolymers used in food package applications or blends of the above.

It should be appreciated that the hinge means can be generally any radially positioned crease or mark that would facilitate manual bending of the plastic at the crease. As such, the hinge means can be a relative thin region in the otherwise relative thicker plastic sheet or the hinge means could be generally any cutting, slicing, scoring, perforation, indentation or marking that would assist the user in bending the plastic at and along such a mark. Typically, the hinge means can be molded into the plastic lid at the time of fabrication of the lid; however, a post fabrication or post molding step such as during die cutting or the like is contemplated as being equivalent for purpose of this invention. Similarly, interlocking means molded into the lid to assist in holding and retaining the lid in a cone shaped configuration can be any type of fastener either molded into or attached to the lid as generally known in the art. Preferably, the interlocking means is either a series of indentations or a continuous indentation or channel that when folded back upon itself will tend to snap together in a compression or friction bond. Most preferably, the interlocking means is a series of frusto-pyramidal protrusion molded into the lid on either side of the radial hinge marks such that they wedge into engagement with each other compressively when the lid or more specifically the fan shaped wedge between two radial hinge means is folded back on the lid.

The actual number of radial hinge means to be present on any single lid and the respective location on the lid will depend upon the number of discrete sizes of drinking cups that are to be used in combination with this multiple size lid. For example, using three radial hinge means with the center radial hinge bisecting the angle formed by the other two, three different size drinking cups (small, medium and large) can easily be covered by a single lid. In principle and in fact, by using three radial hinges with non-bisecting angle, four different sizes can be achieved. Of course, it should be appreciated that more than one region of the overall lid can be used to accommodate precreased sets of hinge means to achieve a greater number of lid sizes. Furthermore, it is contemplated that a universal size lid can be essentially achieved by employing a large number of hinge means distributed essentially continuously around the entire multiple size lid. It is also to be appreciated that various cross sectional geometries can be employed in designing the lid to drinking cup lip engaging means found on the perimeter or outer circumference of the lid. Various indentation/protrusion patterns or the like can also be simultaneously present in this lip engaging means (see FIG. 2) to further assist in holding the lid in a cone shaped configuration for use with the relatively small size drinking cups.

Advantageously, the hinges or fan shaped segments between hinges can be labeled or identified such as to assist the user as to which radial lines to fold to achieve specific discrete lid sizes. Experience indicates that embodiments as illustrated in the drawings will allow sufficient distortion of the lip engaging means between the hinged folds to actually create a positive type snap together locking action that facilitates the use of the lid when adjusting the smaller size drinking cup or container.

Having thus described the invention with a certain degree of particularity, it is to be understood that the invention is not limited to the embodiments set forth herein for purposes of exemplification, but is to be limited only by the scope of the attached claims, including a full range of equivalents to which each element thereof is entitled.

I claim:

1. A multiple size lid comprising a circular disk of plastic having a plurality of hinge forming means positioned radially from the center of said circular disk to the outer circumference for allowing said disk to be folded about a pair of hinge forming means, thus forming a conical shaped surface, and wherein said circular disk of plastic has a lip engaging means integrally formed on the outer circumference for engaging to the lip of a relatively large size container when used as a flat lid and for engaging to itself as well as the lip of a relatively smaller size container when used as a folded conical shaped lid.

2. A multiple size lid of claim 1 further comprising an interlocking means molded in said circular disk for holding said circular disk in a conical shape when folded about a pair of hinge forming means.

3. A multiple size lid of claim 1 wherein said circular disk of plastic contains at least three hinge forming means sequentially positioned adjacent to each other such as to provide for conical configurations that fit up to three relatively smaller sizes.

4. A multiple size lid of claim 2 wherein said circular disk of plastic contains at least three hinge forming means sequentially positioned adjacent to each other such as to provide for conical configurations that fit up to three relatively smaller sizes.

5. A multiple size lid of claim 1 wherein said circular disk of plastic contains three discreet pairs of hinge forming means distributed separately about said circular disk such as to provide for conical configurations that fit three relatively smaller sizes.

6. A multiple size lid of claim 2 wherein said circular disk of plastic contains three discreet pairs of hinge means distributed separately about said circular disk such as to provide for conical configurations that fit three relatively smaller sizes.

* * * * *